US006409531B1

(12) United States Patent
Millard

(10) Patent No.: US 6,409,531 B1
(45) Date of Patent: Jun. 25, 2002

(54) EASILY MATED COMPACT CONNECTOR

(75) Inventor: Kenneth Boyd Millard, Portland, OR (US)

(73) Assignee: MicroHelix, Inc., Portland, OR (US)

( * ) Notice: Subject to any disclaimer, the term of this patent is extended or adjusted under 35 U.S.C. 154(b) by 0 days.

(21) Appl. No.: 09/781,740

(22) Filed: Feb. 12, 2001

(51) Int. Cl.[7] ..... H01R 13/28; H01R 25/00
(52) U.S. Cl. ..... 439/289; 439/909; 439/332
(58) Field of Search ..... 439/289, 91, 909, 439/316, 77, 332

(56) References Cited

U.S. PATENT DOCUMENTS 4,495,917 A * 1/1985 Byers ..... 607/57
4,516,820 A * 5/1985 Kuzma ..... 439/289
4,526,432 A * 7/1985 Cronin et al. ..... 439/320
4,708,661 A * 11/1987 Morland et al. ..... 439/77
4,979,787 A * 12/1990 Lichtenberger ..... 385/88
6,065,791 A 5/2000 Anders et al. ..... 294/116

* cited by examiner

*Primary Examiner*—Brian Sircus
*Assistant Examiner*—Brian S. Webb
(74) *Attorney, Agent, or Firm*—Timothy E. Siegel

(57) ABSTRACT

An electrical connector that comprises a pressure surface bearing a first array of electrical contacts. In addition a side-wall has an exterior surface and is physically connected to the pressure surface. The exterior surface bears a second array of electrical contacts, which are electrically connected to the first array of electrical contacts. Additionally, the electrical connector may include a ball screw for pressing the first array into the second array.

4 Claims, 4 Drawing Sheets

EASILY MATED COMPACT CONNECTOR

STATEMENT OF GOVERNMENT SUPPORT

This invention was made with government support under contract No.: NO1 DC-7-2103 awarded by the National Institute of Health (NIH). The government has certain rights in the invention.

BACKGROUND OF THE INVENTION

Percutaneous connectors are, generally speaking, connectors having a first half that is attached to an animal body (typically to the skull) and a second half that can be connected to the first half for transmitting information out of or into the animal body. Unfortunately, when an animal test subject such as a chimpanzee wears the first half, mating the two halves together typically requires anaesthetization of the test subject. This greatly increases the expense of each instance of connecting the two halves in terms of materials, time and test subject health. The anaesthetization must currently be performed because mating the two halves requires some delicate adjustments, for example the careful tightening of a pair of screws. Additionally, it is typical to implant the first half into the skull and permit skull bone tissue to grow into surface irregularities in the portion of the first half touching skull bone. It is very important that little to no force be applied to the first half so that the first half will not be wrenched out of its setting in the skull bone.

The design goals described above are particularly difficult to meet in the context of a high-density connector. In order to accommodate a high pin density it is generally desirable to use a sheet of anisotropically conducting material to electrically connect the two connector halves. This material must be compressed with a considerable amount (35–70 lbs) of force, which has complicated the task of coupling the connector halves faced by users of prior art connectors.

SUMMARY

In a first separate aspect the present invention is an electrical connector that comprises a pressure surface bearing a first array of electrical contacts. In addition a side wall has an exterior surface and is physically connected to the pressure surface. The exterior surface bears a second array of electrical contacts, which are electrically connected to the first array of electrical contacts.

In a second separate aspect the present invention is an electrical connector, comprising a first pressure surface bearing a first array of contact pads a second pressure surface bearing a second array of contact pads. In addition a pressure applying mechanism presses the first pressure surface into the second pressure surface. This mechanism includes a ball screw and a manual actuator that permits a user to turn the ball screw to press the first pressure surface into the second pressure surface.

The foregoing and other objectives, features and advantages of the invention will be more readily understood upon consideration of the following detailed description of the invention, taken in conjunction with the accompanying drawings.

DETAILED DESCRIPTION OF THE PREFERRED EMBODIMENT

Figure 1:
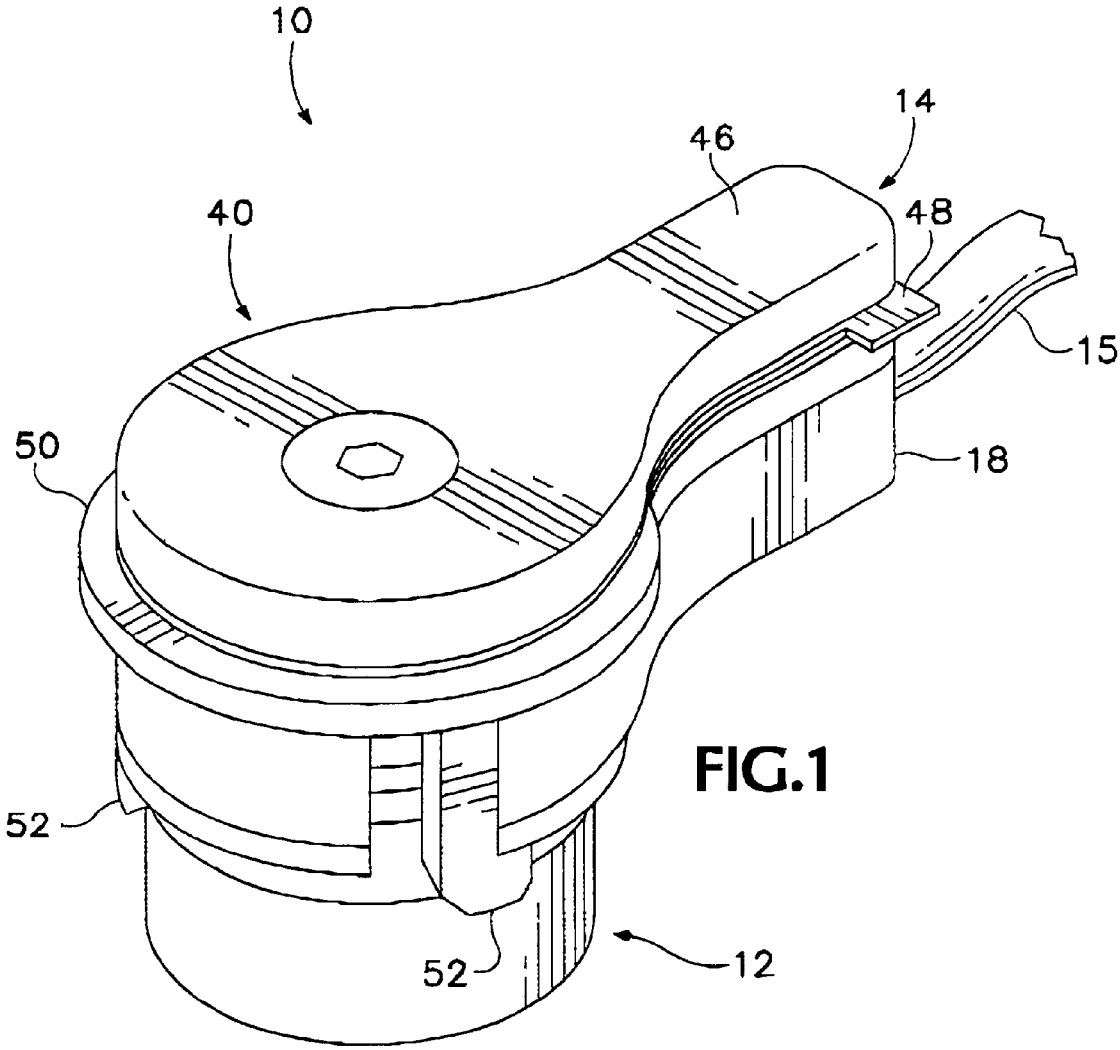
FIG. 1 is a perspective view or a connector according to the present invention in its connected state.

A preferred embodiment of an easily mated, compact connector 10, in this instance a percutaneous connector, includes an lower connector stage 12, which is adapted for implantation into an animal or human host. A purely ex vivo upper connector stage 14 attaches to a lower connector stage 12. A signal cable 15 enters the ex vivo portion through an aperture 16 in a handle 18. After extending through the handle 18 a set of individual wires 20 from signal cable 15 are connected to a flex circuit 22 at a set of wire contact points 24. A set of traces 26, connect wire contact points 24 to a set of pressure contact points 28. When connector 10 is in its connected state, pressure contact points 28 press against a sheet of elastomeric, anisotropically conductive material 29 that electrically connects them to a set of implanted portion pressure contact points 30. Anisotropically conductive material 29 is preferably Fujipoly type WBC. Information on how to obtain this material is available from the Internet site www.fujipoly.com. The lower connector stage 12 is preferably made of a material, such as titanium, having good biocompatibility. The upper connector stage 14 is made of high strength stainless steel. It is desirable, however, that the upper connector stage 14 have a yield strength below that of the lower connector stage 12, so that in the event of failure due to over tightening or a blow to the unit the upper connector stage 14 will give way before the lower connector stage 12, to avoid greater damage to the test subject or patient.

The advantages of this portion of connector 10 may now be evident to skilled persons. Because wires 22 are brought to the exterior side-walls of flex circuit 22 they are not routed through the center top of ex vivo portion 14. This permits the space in this area to be used for the pressure-applying and latching portions of connector 10, rather than to accommodate signal-bearing media, such as wires.

More specifically, the center is occupied by a ball screw 40, which is used to apply pressure between contacts 28 and contacts 30. The ball screw 40 includes a core 42, a set of bail bearings 44, a ball screw handle 46 and a latch 48. In addition a claw ring 50 mates with partially implanted portion 12 by way of a set of three leg claws 52 that fit through a matching set of slots 54 and are retained underneath a rim 56. As the exterior of the claw ring 50 is accessible to an operator, an operator can directly rotate claw ring 50 to place it in the position shown in FIG. 1 with claws 52 retained under rim 56. In an alternative preferred embodiment, claws 52 are extend clockwise so that claw ring 50 is rotated in the same direction (clockwise) as is handle 46 in the process of connecting upper connector stage 14 to lower connector stage 12.

The core 42 defines an inner ball bearing race in the form of seven grooves 60, each one briefly extending along the course of a shallow helix. The claw ring 50 defines an outer ball bearing race in the form of an inner circular groove 62.

When connector 10 is in its loosened state, for attaching and detaching portion 12 to portion 14, the handle 46 and latch 48 are turned clockwise by a one-quarter rotation relative to handle 18. To apply pressure between contacts 28 and 30 handle 46 is moved in a counter-clockwise direction until it rests over handle 18. When the ball screw handle 46 moves the core 42 clockwise, the set of ball bearings 44 positioned between inner race 60 and outer race 62 are caused to rotate and to move in a clockwise direction alone inner race 60. The helical nature of race 60 causes core 42 to move downwardly relative to outer race 62. As claw ring 50, and therefore outer race 62, is fixed in place relative to lower connector stage 12 this action squeezes a pressure fixture 12 and thereby contacts 28 downwardly to engage contacts 30. The rotation of core 42 is facilitated by a bottom set of ball bearings 80, held in place by a bottom race 82.

Because of the great mechanical advantage achieved by the ball screw 40, greater than 50 lbs of pressure may be realized by the simple one-eighth turn of the handle 46 described above. This greatly facilitates the formation of electrical contacts using anisotropically conductive material 29.

Figure 2:
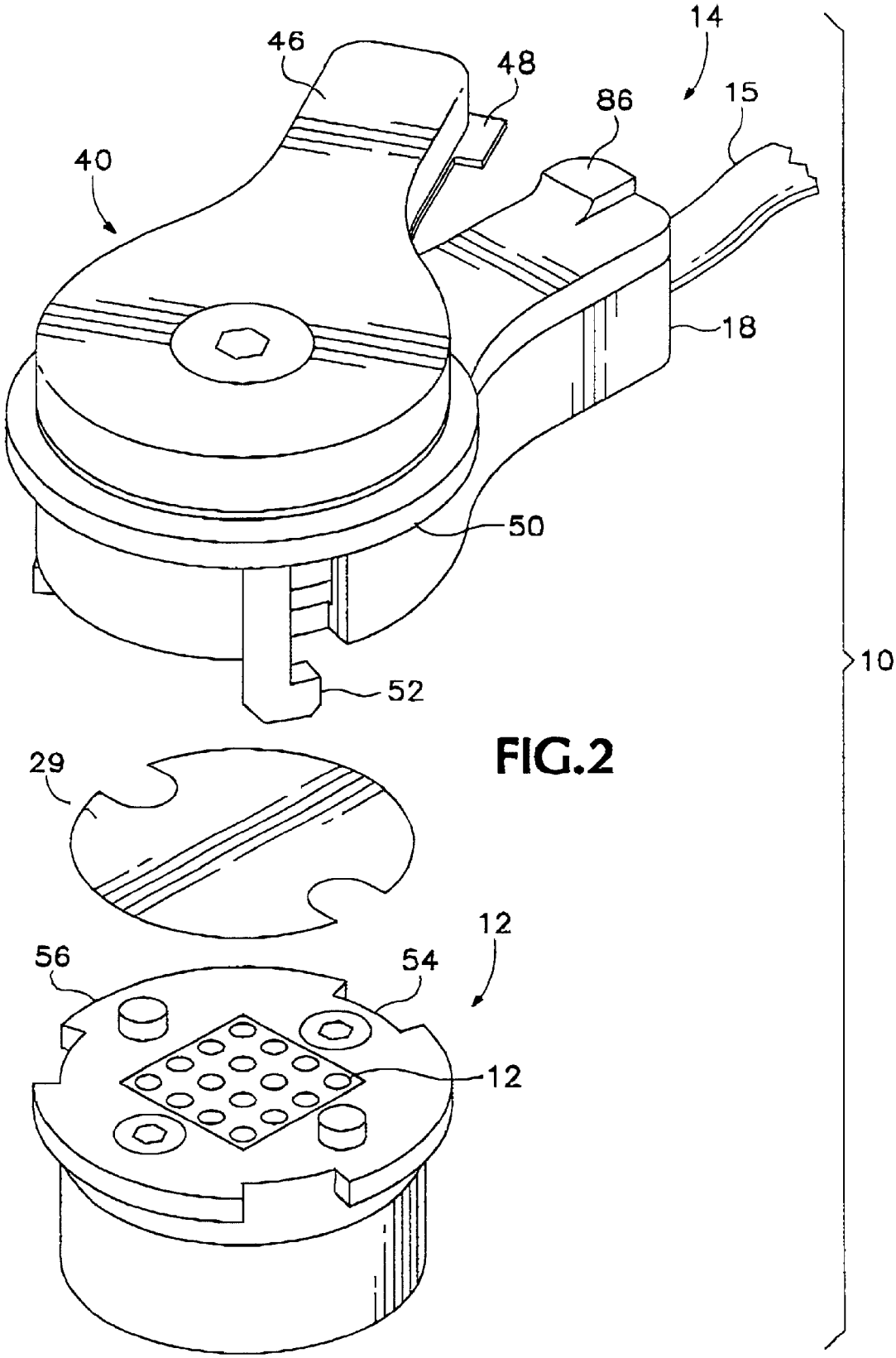
FIG. 2 is a perspective view of the connector of FIG. 1, with the two-connector stages separated.
Figure 3:
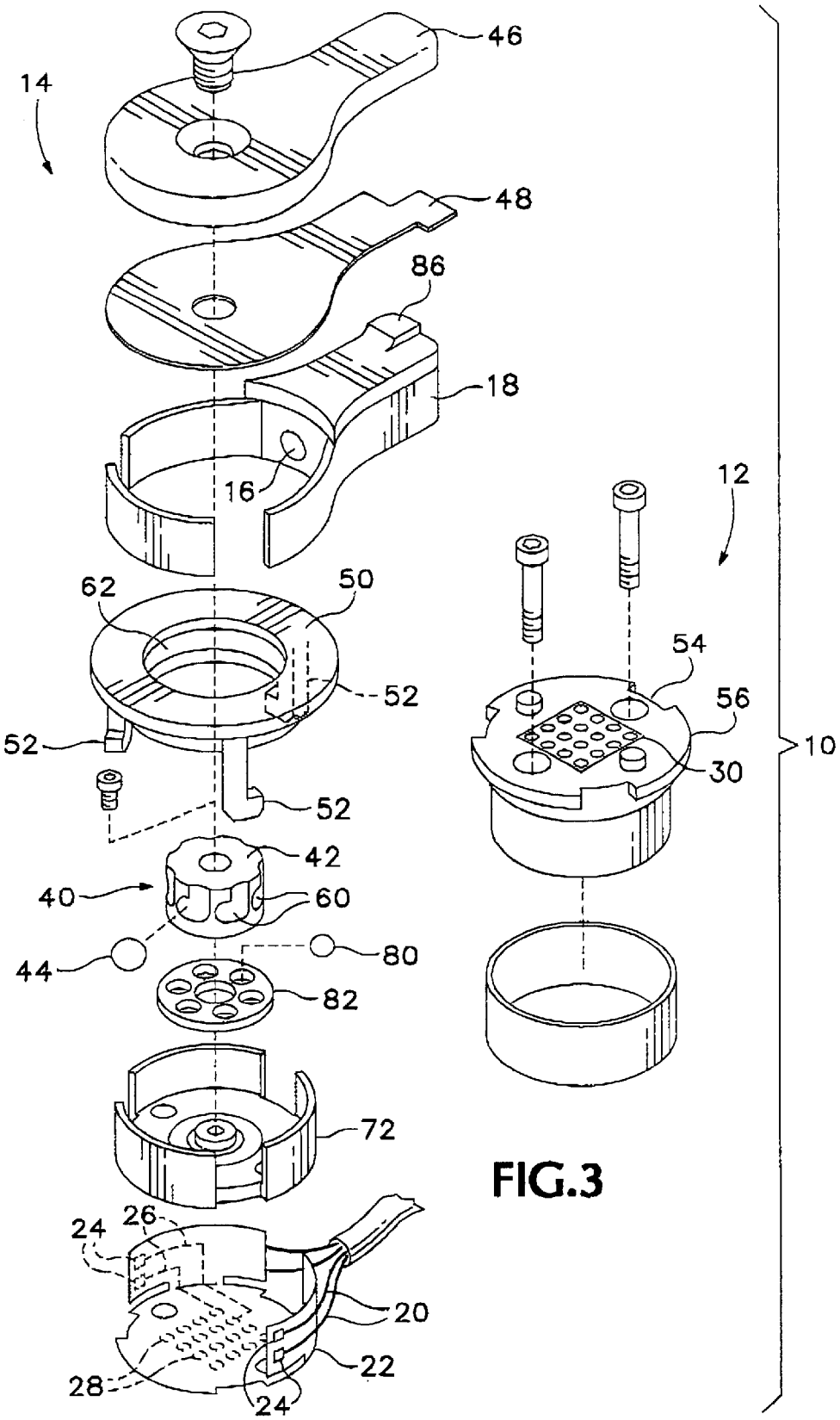
FIG. 3 is an exploded perspective view of the connector of FIG. 1.
Figure 4:
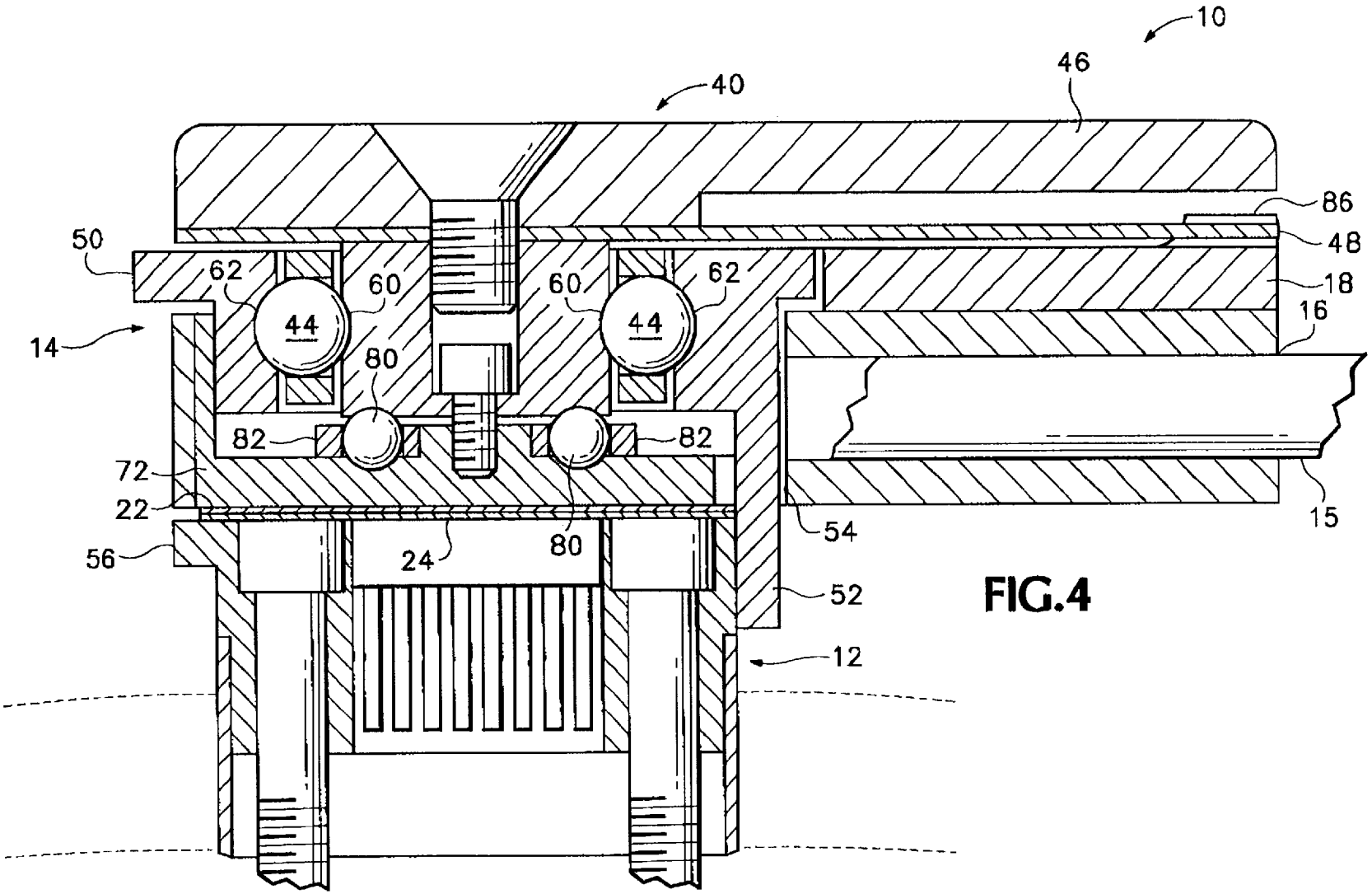
FIG. 4 is a cross-sectional view of the connector of FIG. 1 taken along line 4—4 of FIG. 1.

After an operator places claws 52 under rim 56 as described above, he rotates the handle 46 and latch 48 clockwise to effect the tightening described above. In the tightened position shown in FIG. 1, the latch 48 is retained by a catch element 86 (shown in FIG. 2).

The terms and expressions which have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. An electrical connector, comprising:

a) a first pressure surface bearing a first array of contact pads;

b) a second pressure surface bearing a second array of contact pads; and c) a pressure applying device for pressing said first pressure surface into said second pressure surface, said pressure applying device including:

(i) a ball screw including a race having a plurality of grooves, each groove accommodating a ball bearing; and (ii) a manual actuator permitting a user to turn said ball screw to press said first pressure surface into said second pressure surface.

2. The electrical connector of claim 1, wherein said race has more than two grooves.

3. The electrical connector of claim 1, wherein said first pressure surface and said second pressure surface must be pressed together by a minimum force to achieve said set of electrical connector and wherein less then a complete rotation of said ball screw is necessary to achieve said minimum force.

4. The electrical connector of claim 3 wherein less than a one half rotation of said ball screw is necessary to achieve said minimum force.

* * * * *

UNITED STATES PATENT AND TRADEMARK OFFICE

CERTIFICATE OF CORRECTION

PATENT NO. : 6,409,531 B1
DATED : June 25, 2002
INVENTOR(S) : Kenneth Boyd Millard It is certified that error appears in the above-identified patent and that said Letters Patent is hereby corrected as shown below:

Column 2,
Line 43, change “bail” to -- ball --.

Column 3,
Line 1, change “alone” to -- along --.
Line 6, change “12” to -- 72 --.

Signed and Sealed this

Twenty-fourth Day of September, 2002

*Attest:*

*Attesting Officer*

JAMES E. ROGAN
*Director of the United States Patent and Trademark Office*